United States Patent [19]

Mueller

[11] 4,191,483

[45] Mar. 4, 1980

[54] TYPEWRITER KEY ACTION

[75] Inventor: Hans W. Mueller, Cortland, N.Y.

[73] Assignee: SCM Corporation, New York, N.Y.

[21] Appl. No.: 896,952

[22] Filed: Apr. 17, 1978

[51] Int. Cl.[2] ..... B41J 23/06; B41J 25/02

[52] U.S. Cl. ..... 400/369; 400/368; 400/375

[58] Field of Search ..... 400/368, 369, 375

[56] References Cited

U.S. PATENT DOCUMENTS

| | | | |
|---|---|---|---|
| 2,858,925 | 11/1958 | Muller | 400/368 |
| 3,225,884 | 2/1965 | Krauss et al. | 400/368 |
| 3,578,128 | 5/1971 | Frechette | 400/369 |
| 3,706,366 | 12/1972 | Hishida et al. | 400/375 |
| 3,809,205 | 5/1974 | Madison | 400/369 |
| 3,981,385 | 9/1976 | Mueller et al. | 400/375 |

FOREIGN PATENT DOCUMENTS

| | | | |
|---|---|---|---|
| 440060 | 1/1927 | Fed. Rep. of Germany | 400/368 |
| 2114273 | 9/1972 | Fed. Rep. of Germany | 400/375 |
| 2127214 | 1/1973 | Fed. Rep. of Germany | 400/375 |
| 1345328 | 10/1963 | France | 400/375 |

*Primary Examiner*—William Pieprz

*Attorney, Agent, or Firm*—William E. Mear, III; Ernest F. Weinberger; Milton M. Wolson

[57] ABSTRACT

A direct connection provides coupled movement from a keylever to an interposer of a simple key action in a typewriter. The connection includes an abutment integrally constructed on the keylever inserted within a recess on the interposer to effect movement of the interposer when the keylever is caused to move. Depression of the keylever pushes the interposer downward against a pawl that will engage a rotating power roll to cause initiation of a print movement of a typebar. The keylever while being restored by an underlying spring, will then pull the interposer upward to rest. The keylever and interposer are in planar alignment that is maintained by having the connection contained within a slot of a support member in the typewriter.

1 Claim, 8 Drawing Figures

TYPEWRITER KEY ACTION

BACKGROUND OF THE INVENTION

1. Field of the Invention

This invention relates to key actions for power driven typewriters and more particularly to a coupling arrangement between a keylever and an interposer.

2. Description of the Prior Art

A simple reliable key action is a vital necessity for the manufacturer of an economical quality typewriter. The key actions employed for use in contemporary typewriters must be capable of withstanding the increasing frequent demands required of such modern machines. Combine that factor with a need for producing key actions at the lowest possible cost to the manufacturer brings together an achievement long sought by the typewriter industry, namely a reliable, low cost structure. Electric typewriters having typebars include a significant number of individual key actions (normally at least 42), it is readily apparent that, any simplifications effecting the key action results in a substantial reduction of the total cost. A prime example of such a simplification effecting cost is to educe the number of moving parts required for each key actioh, which in turn significantly decreases the total number of typewriter parts. Accordingly, a further cost savings is realized as a result, because the required assembly and labor time is similarly reduced. In many prior art key actions, critical moving parts require at least one and for some several bend forms. These have the disadvantage of being both costly and complex, they require a precise manufacturing operation for obtaining the form and for proper function must be inspected. Once assembled, formed parts tend to obscure other parts, complicating trouble shooting and part replacement. To avoid these problems it is most desirable and economical to employ parts having a flat blank construction. By simplifying the key action, costly critical assembly adjustments requiring skilled personnel are minimized or avoided. The use of fewer moving key action parts reduces future repair and part replacement due to failure or wear.

An example of a simplified key action arrangement in a typewriter is U.S. Pat. No. 1,077,281. The key action includes a keylever directly connected to and vertically aligned with one arm of a two armed rocking lever. The other arm of the rocking lever is connected to a sliding link which in turn is connected to a typebar. The direct connection between the keylever and the rocking lever includes a recess on the keylever which fits into a circular end portion on one of the arms of the rocking lever. The other arm of the rocking lever is similarly shaped and fits within a recess on the sliding link. The sliding links are bent each a different amount for alignment with their corresponding typebar. This key action arrangement is possible because it is used in a manual typewriter.

In most conventional powered key actions having a continually driven power roll or toothed snatch roll, a pawl or cam is pivotally mouned on an actuator or sublever for displacement into driving engagement with the rotating power roll in response to keylever depression. As a result of such a driving engagement, a typebar is caused to perform a printing stroke.

In these conventional key actions, there is normally provided a mechanism operatively connecting the keylever with the pawl or cam for producing a reliable key action function. Usually included within such mechanisms is an intermediate lever or interposer that moves in response to keylever depression. A prior art key action U.S. Pat. No. 3,915,277 issued Oct. 28, 1975 to Samuel D. Cappotto et al, as inventor and assigned to the same assignee as the present application, discloses a horizontal interposer being spring loaded against a bellcrank that is pivotally connected to a keylever. Depression of the keylever will increase the spring tension applied to the interposer by pivoting the bellcrank until the interposer is pushed off a ledge by the descending keylever. The stretched spring will then snap the interposer against a pawl that engages the power roll to initiate the printing movement of the typebar.

The Cappotto et al patent is an improved key action, in that it provides for rapid insertion of the pawl into the path of rotating teeth on the power roll upon keylever depression. The mechanism contains many moving parts for operation of the interposer, namely a bellcrank pivotally mounted on a pin to a keylever. Such structure has the disadvantage of being both complex and costly to manufacture. The construction also requires a spring that must be individually connected to each interposer and bellcrank, thus further complicating the key action. Each keylever used in the Cappotto key action is formed with an ear, requiring the disadvantage of an additional costly manufacturing operation. A finger on the bellcrank is spring loaded against the interposer and a keylever ear slides against the interposer subjecting the parts to undesirable frictional wear. Such key action complexities and cost are severely compounded, when applied to a typewriter having a large number of such individual mechanisms.

Other prior art key actions still fall short of the optimum requirements for a key action. Many prior art key actions include a bellcrank pivotally mounted on the keylever. The bellcrank is spring biased for actuation of the interposer when the keylever is depressed and yieldably permitting the interposer to completely restore after a single typing operation. Other key action mechanisms include parts that must be adjusted for controlling the driving engagement between the cam and the power roll to vary typebar impression. The design structure of the present invention avoids the above design complexities and thereby reduces the manufacturing cost.

SUMMARY OF THE INVENTION

The present invention is a simple key action arrangement for a power driven typewriter that utilizes typebars to perform a typing operation. The key action includes a keylever that is pivotally mounted to a support member in the typewriter. An abutment on an extending arm of the keylever is constructed to be inserted within an elongated recess of a pivotally mounted interposer. While inserted in the recess, the abutment will simultaneously engage opposed bearing edges of the recess thus forming a direct connection between the keylever and the interposer that permits the interposer to be pivoted during keylever movement. When the keylever is at a rest position, the interposer is supported at the direct connection. As the keylever descends, it pushes the interposer downward against a pawl of an actuating means which in turn will engage a power roll initiating the printing movement of the typebar. A single cantilever spring underlies each keylever for restoring the keylever to rest position. In being so restored, the keylever in turn lifts the interposer back to its rest position. A repeat key action is provided, and includes a repeat keylever which is directly connected to the interposer in the same manner as the single key action. In the repeat mode of operation the keylever as well as the interposer are pivoted to a repeat position which is a further amount than for single action. The direct connection is vertically guided at all positions of the keylever and interposer by a slot in the support member. The present key action construction permits several critical parts, namely the keylever and interposer, which can be economically manufactured by flat stamping.

Accordingly, an object of the present invention is to provide an improved key action arrangement for initiating a printing movement of a typebar in a typewriter.

Another object of the present invention is to provide a key action arrangement characterized by the elimination of parts normally required in prior art key actions without sacrifice of function and reliability.

Another object of the present invention is to provide a low cost key action arrangement having fewer parts.

A further object of the present invention is to provide a dependable key action arrangement in which the keylever directly engages the interposer at all times enabling controlled movement of the interposer by the keylever.

A still further object of the present invention is to provide a versatile key action arrangement that can be used for repeat mode of actuation as well as for single mode of actuation.

Other objects, features, and advantages of the invention will become more apparent from the following description, including the appended claims and accompanying drawing.

DESCRIPTION OF THE PREFERRED EMBODIMENT

Figure 1:
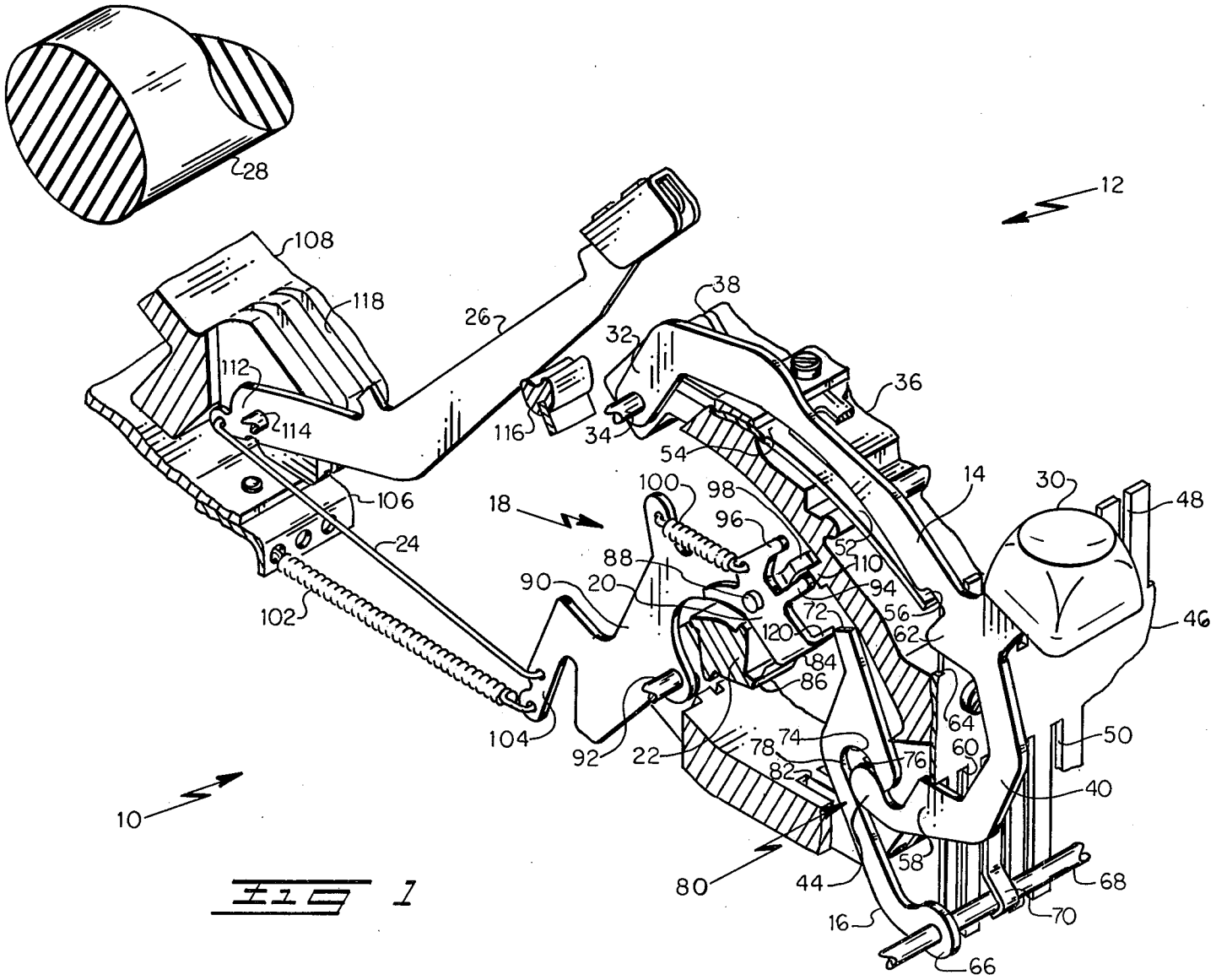
FIG. 1 is a perspective view of a portion of a typewriter embodying the invention.

Referring to the drawings and more particularly to FIG. 1, there is shown a key action 10 arranged in a typewriter 12 according to the present invention. Key action 10 includes a depressable keylever 14 for effecting the position of a pivotal interposer 16; an actuating means 18 having a pivotal pawl member 20 located near the interposer 16; a continually rotating toothed power roll 22 engageable by pawl 20 in response to downward movement of interposer 16 upon depression of keylever 14. A link 24 connects the actuating means 18 to a typebar 26. A printing operation is executed by the typebar 26 impacting a platen 28 after actuating means 18 has been powered by the engagement of pawl 20 with power roll 22. It should be noted that the key action 10 herein described refers to just one of as many as possibly 42 or more similar key actions arranged in columns and rows used to form a complete typewriter 12.

As seen in FIG. 1, key action 10 includes a finger-engageable keybutton 30 mounted on the keylever 14. One end 32 of keylever 14 is pivotally supported about a shaft 34 that is slideably secured within a slotted support member 36 in the typewriter 12. Support end 32 of keylever 14 is guided by upper slots 38 in support member 36. The overall profile construction of keylever 14 is semi-circular in shape, somewhat resembling an inverted "c", th eupper end of which corresponds to support end 32. A downwardly extending arm 40 on keylever 14 corresponds to the lower end portion of the inverted "c" profile. Extending arm 40 terminates in a substantially curved abutment 44.

Figure 4:
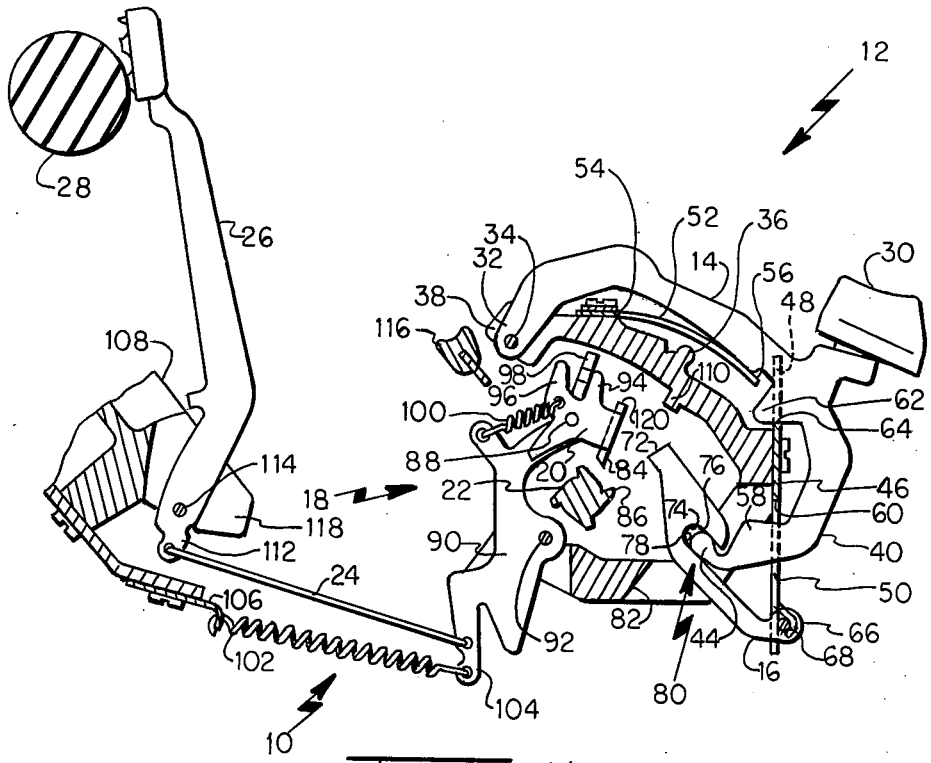
FIG. 4 is a view similar to that of FIG. 3 with the typebar pivoted to print position.

Support member 36 carries on its front a guide section in the form of a comb 46. The comb 46 includes a plurality of aligned opposed slots 48 and 50. The upper portion of keylever 14 extends through slot 48 and extending arm 40 projects through slot 50 thus providing a dual guide for keylever 14. A flat leaf spring 52 has one end 54 attached to the support member 36, and its other end 56 extends to engage the underside of keylever 14, urging it upwardly to its rest position. The upward travel of keylever 14 is limited by having an upstop projection 58 on extending arm 40 biased by spring 52 against an end wall 60 of slot 50 on comb 46. The keylever 14 is pivotal between its rest position and a depressed position. The downwardly travel of keylever 14 is limited when a downstop projection 62 on keylever 14 abuts against a base edge 64 of slot 48, at which point, the keylever 14 is fully depressed (FIG. 4).

Interposer 16 is pivotally supported at one end 66 on a fulcrum rod 68 which is fixedly supported on the-lower end of comb 46 by bent ear 70. The free end of interposer 16 carries at its tip a nose portion 72, and intermediate the end 66 and nose portion 72 there is formed a downwardly extending recess 74 defined by approximately parallel opposed bearing edges 76 and 78 which slidingly engage abutment 44. When keylever 14 is at its rest position, interposer 16 is supported at its rest position by the engagement between abutment 44 and recess edge 76. At rest position, interposer 16 is inclined at an angle of approximately 45° from end 66, extending upwardly toward the rear, terminating at nose 72. The sliding engagement or direct connection as hereinafter referred to between the abutment 44 and the recess 74 and shown as 80, will permit relative free movement therebetween. For example, the depression of keylever 14 will cause interposer 16 to pivot about end 66.

Both the keylever 14 and interposer 16, proximate the connection 80, are slideably confined within a slot 82 in support member 36 so as to insure constant planar alignment during movement of these parts. The width of slot 82 is selected so as to provide the foregoing by not permitting the keylever 14 and interposer 16 to be in sidewise relation.

An interposer rest position, nose portion 72 of interposer 16 is poised near the pawl member 20 of actuating means 18. Pawl 20 has a formed tooth 84 adaptable for a driving engagement by any of the teeth 86 on the rotating power roll 22, when tooth 84 is placed in to the rotating circular path of teeth 86. Pawl 20 is pivotally connected by a pin 88 to an actuator 90 of actuating means 18 which in turn is pivotally supported by a shaft 92. Pawl 20 is pivotable between a pair of upstanding arms 94 and 96 contacting a bent ear 98 on actuator 90. A coil tension spring 100 is connected between pawl 20 and actuator 90 for biasing the upstanding arm 94 of pawl 20 counterclockwise against bent ear 98 of actuator 90. An actuator coil tension spring 102 is connected between a lower arm 104 of actuator 90 and bracket 106 on a typebar segment 108 fixed in typewriter 12 for biasing actuator 90 so that bent ear 98 bears against a stop projection 110 on support member 36. The link 24 connects lower arm 104 of the actuator 90 to an end 112 of the typebar 26 which is pivotally supported intermediate its ends by a shaft 114 carried by the typebar segment 108. Typebar 26 is urged to rest against a typerest 116 by the action of spring 102 urging actuator arm 104 toward the typebar 26 and (through link 24) thereby biasing the typebar 26 clockwise about shaft 114. When actuated, typebar 26 is guided in a slot 118 in typebar segment 108.

Figure 2:
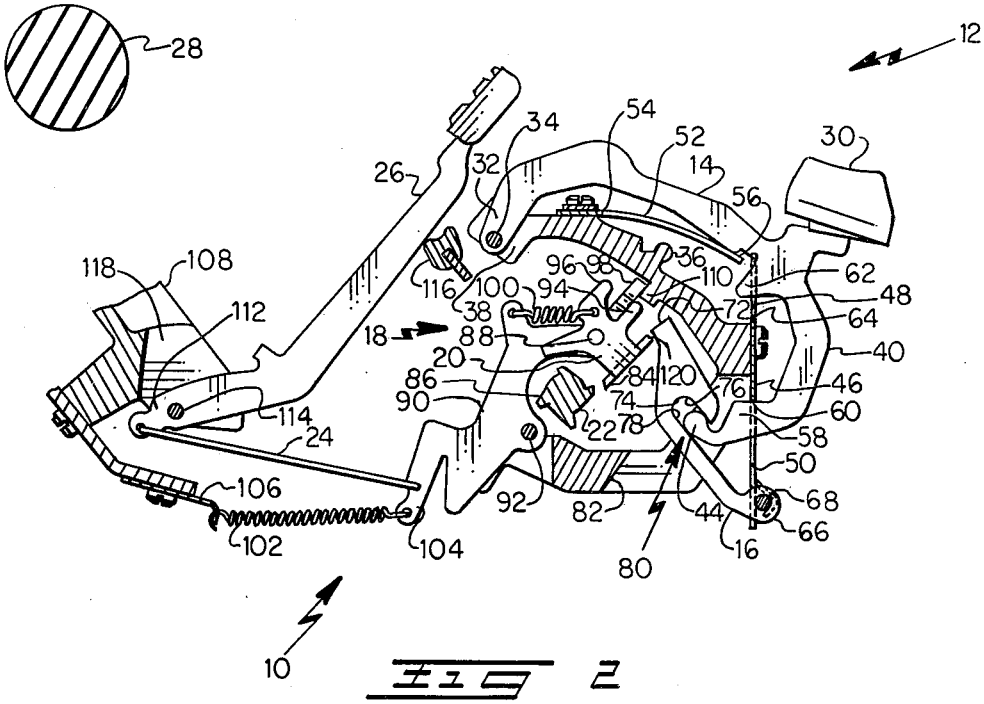
FIG. 2 is a left side elevation view of the typewriter shown in FIG. 1 with the key action in rest position.

FIGS. 2 to 5 represent successive steps of the key action 10 during a single printing operation. Other single power typewriter operations initiated by keylevers can employ the same structure of the keylever 14 and interposer 16. These single operations include spacing, backspacing, case shift and so forth. For completeness, FIG. 2 shows in cross-section the key action 10 in rest position as in FIG. 1.

Figure 3:
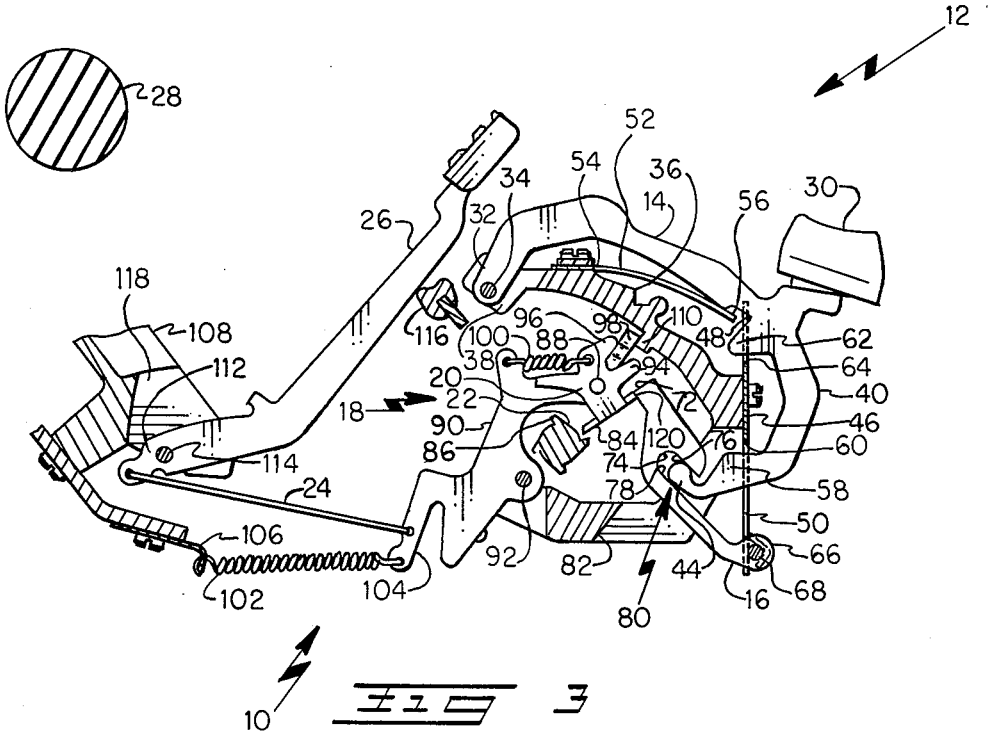
FIG. 3 is a view similar to that of FIG. 2 just prior to typebar printing movement.

Referring to FIG. 3, initial depression of keylever 14, to a position just prior to downstop projection 62 abutting base edge 64 of slot 48, causes the interposer 16 to pivot downwardly counterclockwise about rod 68, due to abutment 44 pushing against bearing edge 78 of recess 74. The nose portion 72 of interposer 16 engages a top surface 120 of tooth 84 causing pawl 20 to pivot clockwise about pin 88 thereby stretching spring 100, until the upstanding ear 96 of pawl 20 contacts bent ear 98 of actuator 90. In this position tooth 84 is placed in the rotational path of one of the teeth 86 on power roll 22. Pawl 20 is limited in its pivotal movement by arm 96 bearing against bent ear 98, so that when one of the teeth 86 on rotating power roll 22 engages tooth 84, the actuating means 18 is caused to pivot counterclockwise about pivot shaft 92 because pawl 20 is locked to actuator 90 so as to transfer its motion to actuator 90. As the actuator means 18 is being driven by power roll 22, the top surface 120 of pawl tooth 84 slips out from under nose portion 72. Interposer 16 is now supported at its actuated position with surface 76 resting upon circular abutment 44.

Referring to FIG. 4, depression of keylever 14 is limited by projection 62 abutting against base edge 64 of slot base 48. The motion of actuator 90 is transferred through link 24 to power typebar 26 counterclockwise about pivot shaft 114 toward platen 28. Just prior to typebar 26 impact with platen 28, tooth 84 separates from engagement with power roll 22 due to the radial length of actuator 90 about its pivot 92 being greater than that of the radial length of power roll 22. Spring 100 then returns upstanding arm 94 of pawl 20 against bent ear 98, as momentum imparted to typebar 26 carries it into striking engagement with platen 28.

Figure 5:
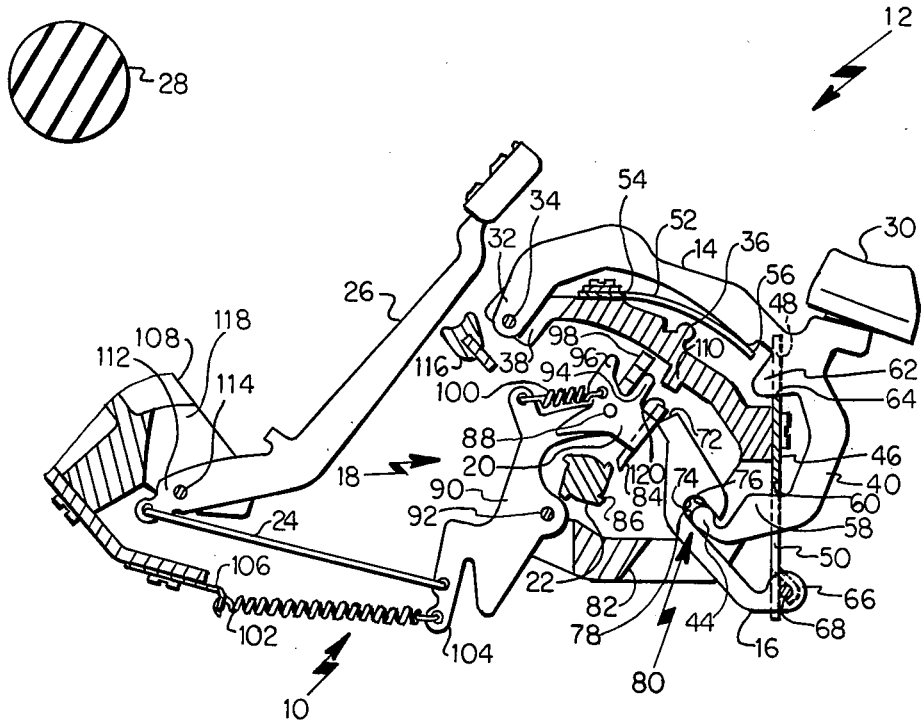
FIG. 5 is a view similar to that of FIG. 4 with the key action partially restored.

Upon completion of the printing operation, the actuating means 18 and typebar 26 are partially restored by actuator coil spring 102 to a position as shown in FIG. 5. Actuator coil spring 102 urges actuator 90 clockwise about pivot shaft 92, and through link 24 pulls typebar 26 toward its rest position. In the partially restored position, a repeat printing operation is impossible because the nose portion 72 of interposer 16 is aligned to contact the returning formed tooth 84 of pawl 20 high enough above its pivot pin 88 to avoid pivoting the pawl 20 into power roll 22 engagement.

When the keybutton 30 on keylever 14 is released, key action 10 is allowed to fully restore to rest position, as shown in FIG. 2. The cantilever flat spring 52 urges keylever 14 upward which in turn through the direct connection 80 lifts interposer 16. Once nose portion 72 has been lifted to a point above the arcuate path of pawl 20, actuator 90 is allowed to return to its rest position having bent ear 98 bearing against stop projection 110.

Figure 6:
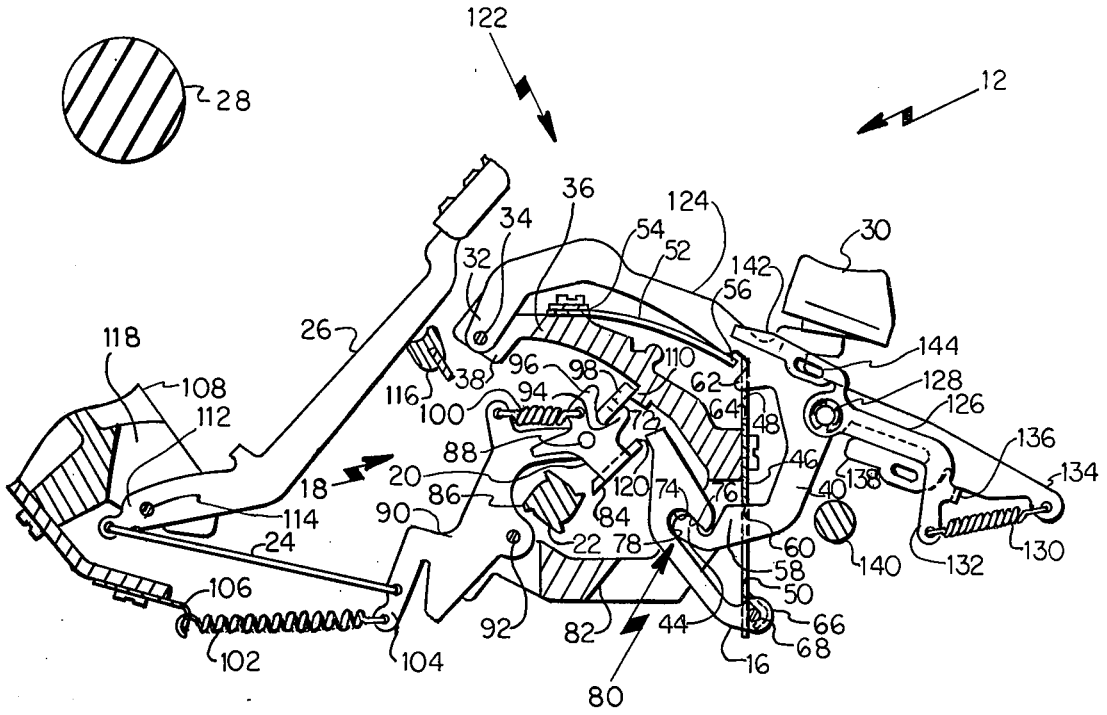
FIG. 6 is a left side elevation view of the typewriter similar to that of FIG. 2 with a repeat key action in rest position.
Figure 7:
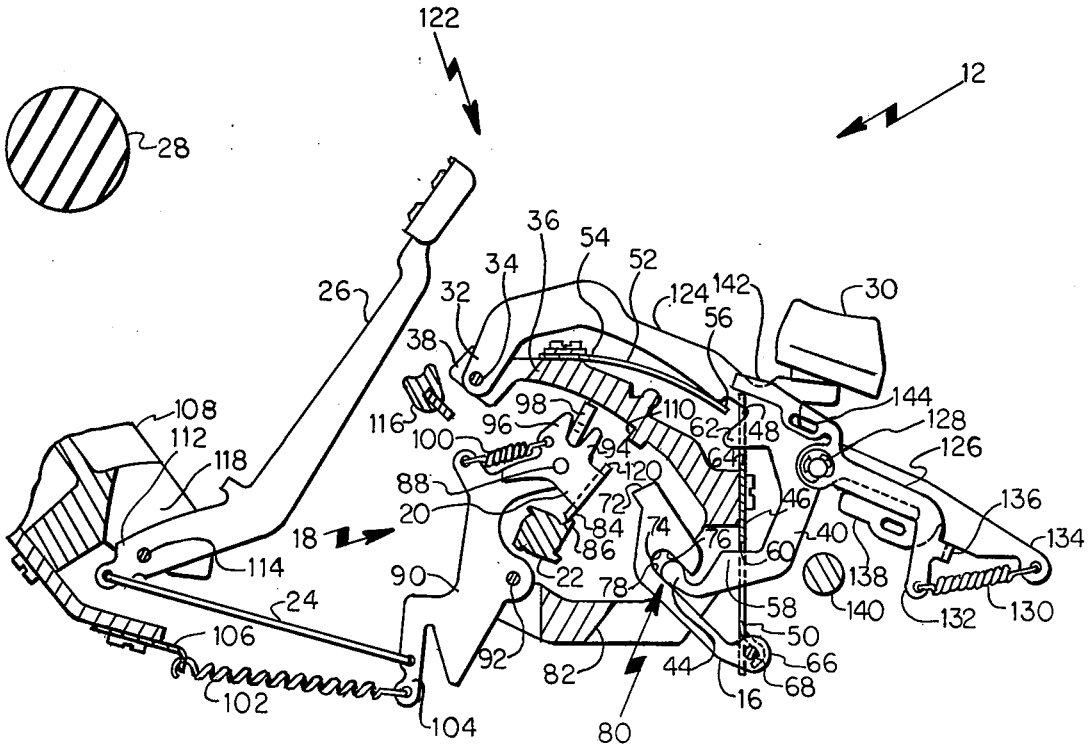
FIG. 7 is a view similar to that of FIG. 6 during printing movement of the typebar.
Figure 8:
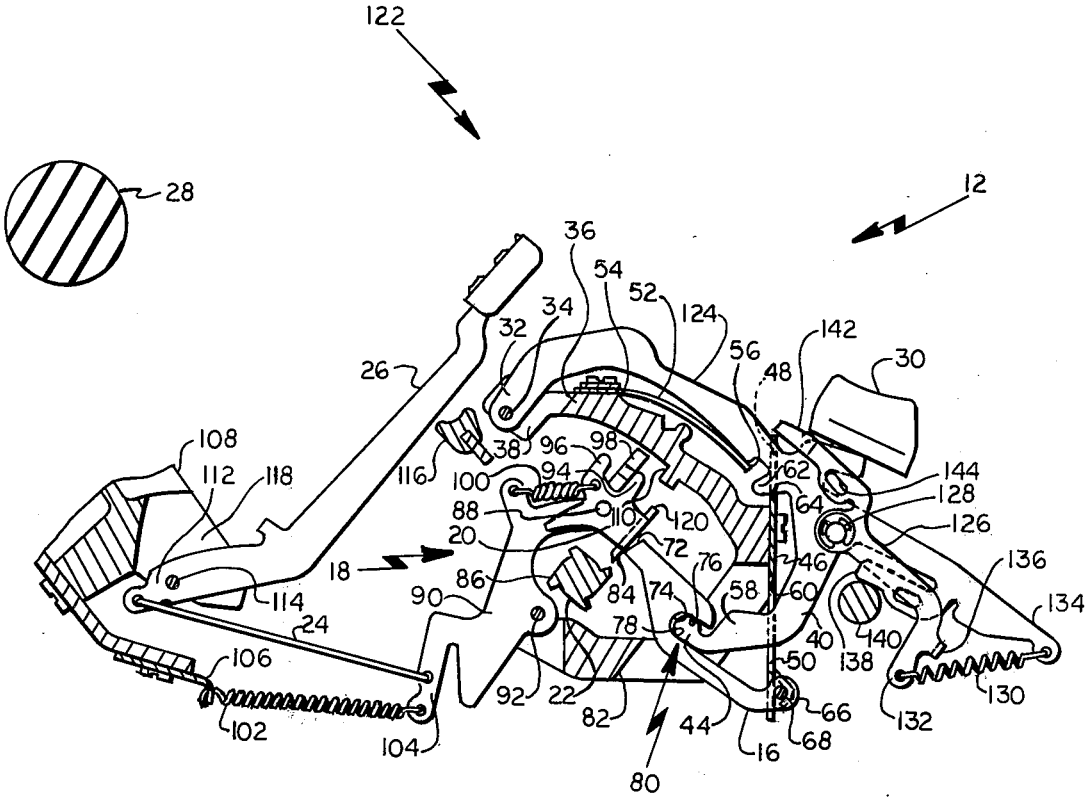
FIG. 8 is a view similar to that of FIG. 7 with the repeat keylever depressed to a repeat position.

FIGS. 6, 7 and 8 represent successive steps in a repeat key action 122 printing operation embodying the identical direct connection 80 between interposer 16 and a repeat keylever 124. Repeat capability is desirable for symbols that are often repeated in clusters such as X's, periods, underlines and hyphens. Other power repeat operations which have the keylevers connected to interposers by the direction connection 80 are also possible, such as repeat spacing, repeat backspacing, and so forth. Wherever possible, for ease of comparison, identical structures are identified by the same refence numerals as before.

Referring to FIG. 6, the repeat key action 122 includes the depressable repeat keylever 124 having a Z-shaped bellcrank 126 pivotally connected on a stud 128 to one side of the repeat keylever 124. A coil tension spring 130 is connected between an end 132 of bellcrank 126 and a free end 134 of keylever 124 for urging bellcrank 126 counerclockwise to a position limited by a bent ear 136 on bellcrank 126 bearing against repeat keylever 124. A lower finger 138 on repeat keylever 124 is for limiting downwardly depression of the repeat keylever 124 and is aligned to engage a shaft stop 140, upon full depression of repeat keylever 124 into the repeat position. The gap between downstop projection 62 and the base edge 64 of slot 48 for repeat key action 122 has been increased, as for example, by reducing the amount projection 62 extends downward. This allows the additional repeat keylever 124 travel necessary for function of the repeat printing operation. An upper finger 142 is provided on bellcrank 126 which normally is disposed above and spaced from the top of guide comb 46 due to the limited pivotal movement of the bellcrank 126 under the abutment of ear 136 and repeat keylever 124.

As shown in FIG. 7, the repeat keylever 124 has been partially depressed to a level corresponding to that required for single actuation. During this depression, nose portion 72 drives pawl 20 clockwise and pawl tooth 84 into driving engagement with one of the teeth 86 on power roll 22. When upper finger 142 just contacts the top surface of guide comb 46, further depression of the repeat keylever 124 will cause bellcrank 126 to pivot clockwise about stud 128, thereby stretching tension spring 130. It is this increased resistance, fed back to the repeat keylever 124 that allows the operator to distinguish the depressional level required for single actuation, opposed to further depression of the repeat keylever 124 into the repeat mode of operation. Should a single actuation of the repeat key action 122 be desired, the repeat keylever 124 is depressed only to this level.

Depression of the repeat keylever 124 into a repeat actuation position is shown in FIG. 8. The necessary force required to depress the repeat keylever 124 into the repeat mode is increased because the resistance offered in tension spring 130, between repeat keylever 124 and bellcrank 126, is added to the downward resistance of the cantilever flat spring 52. Downward movement of the repeat keylever 124 is limited by lower finger 138 abutting shaft stop 140. The repeat mode of operation sensed by the operator is provided with an adjustment. The finger 142 on bellcrank 126 is bendable by insertion of a screwdriver or other suitable tool into a slot 144 provided in finger 142. To advance or delay contact between finger 142 with the top of guide comb 46, finger 142 is bent either upward or downward. The result of which is to advance or delay initial stretching of coil tension spring 130. As the bellcrank 126 pivots clockwise, the interposer 16 is caused to pivot counterclockwise about fulcrum rod 68 an amount greater than that required for single actuation. Nose portion 72 now will contact the returning face of tooth 84 of pawl 20 below its pivot pin 88. The returning pawl 20 is thereby caused to pivot clockwise directing tooth 84 downwardly into driving engagement with the power roll 22. As long as the repeat keylever 124 is held at its repeat position, nose portion 72 of interposer 16 will continue to initiate printing movement of the typebar 26 each time the actuating means 18 returns toward its rest position.

Upon release of the repeat keylever 124 the cantilever flat spring 52 lifts the repeat keylever 124, and in so moving permits the coil tension spring 130, between repeat keylever 124 and the bellcrank 126, to pivot the bellcrank 126 counterclockwise returning bent ear 136 against repeat keylever 124. In addition the upward movement of repeat keylever 124 causes the interposer 16 to be lifted from its repeat printing position toward rest by the direct connection 80.

Accordingly, it can readily be seen from the above that applicant's invention provides an efficient and effective key action arrangement for actuating the printing movement of a typebar in a straight forward, uncomplicated, highly reliable manner. Further, the present key action is extremely simple, having a minimal number of parts, namely the keylever 14, and the interposer 16. Because of the simplicity of construction, the key action 10 is relativey durable and maintenance free. The economic simplicity of such a construction is enhanced since the keylever 14 and interposer 16 are arranged in planar alignment enabling such parts to be manufactured from flat blanks. The present key action arrangement described herein has been shown to be extremely versatile by being adaptable for use in single actuation key action and repeat actuation key action. Further, by having the interposer 16 directly engageable with the keylever 14, the use of intermediate apparatus such as bellcranks, levers and cams has been avoided.

Although the invention has been described in its preferred form with a certain degree of particularity, it is understood that the present disclosure of the preferred form has been made by way of example and that numerous changes in the details of construction and the combination and arrangement of parts can be resorted to without departing from the spirit and the scope of the invention as hereinafter claimed.

What is claimed is:

1. A key action for a typewriter including a typebar pivotally mounted for movement from a rest position to a print position, an actuating means connected to the typebar to effect the printing movement of the typebar, a power roll rotatably mounted in the typewriter for engagement with a pivotal pawl of the actuating means to power the typebar printing movement, the improvement comprising:

a support member fixed in the typewriter;

a keylever pivotally mounted on said support member for movement from a rest position to a first depressed position and beyond to a repeat depressed position;

an elongated interposer mounted on a shaft fixed in the typewriter, said interposer movable from an initial position to a first and second pivoted position;

means connecting said keylever to said interposer for direct control of the movement of said interposer in response to movement of said keylever, said connecting means including an abutment on said keylever closely received within a recess on said interposer;

a flat leaf spring having one end attached to said support member and horizontally extending therefrom to engage said keylever for restoring said keylever to said rest position from said first and repeat depressed positions, and for restoring said interposer from each one of said pivoted positions to said initial position through said connecting means; and a nose portion on said interposer having three operable positions for controlling the typebar, said nose engages a top surface of the pawl to pivot the pawl into engagement with the power roll for causing a single typebar printing movement in response to keylever movement to said first depressed position, said nose abuts the pawl below said top surface to avoid pivoting the pawl to prevent further actuation of the typebar when the typebar remains in said first depressed position, and said nose engages the pawl below its pivot to repeatedly pivot the pawl into engagement with the power roll for causing repeat typebar printing movement in response to keylever movement to said repeat depressed position and when the keylever remains in said repeat depressed position.

* * * * *